United States Patent [19]

Fenton

[11] 4,380,942

[45] Apr. 26, 1983

[54] TORQUE-TRANSMITTING TOOL ASSEMBLY

[76] Inventor: John W. Fenton, 1258 Aalapapa Dr., Kailua, Hi. 96734

[21] Appl. No.: 277,068

[22] Filed: Jun. 25, 1981

[51] Int. Cl.[3] ..... B25B 15/00

[52] U.S. Cl. ..... 81/436

[58] Field of Search ..... 81/436, 460, 461

[56] References Cited

U.S. PATENT DOCUMENTS

| | | | |
|---|---|---|---|
| 961,515 | 6/1910 | Montgomery | 81/460 X |
| 2,445,525 | 7/1948 | Gulden | 145/50 A |
| 3,470,786 | 10/1969 | Martins | 81/461 X |
| 4,191,228 | 3/1980 | Fenton | 81/436 |
| 4,258,596 | 3/1981 | Bisbing | 81/436 |

*Primary Examiner*—Jimmy C. Peters

*Attorney, Agent, or Firm*—Dunlap & Codding

[57] ABSTRACT

A tool assembly comprising a tool member receivable in a recess formed in a driven member. The tool member comprises a shank element, a plurality of tier elements integrally stacked coaxially thereon, and an apex element. Each of the tier and apex elements comprises first and second torque sections, each of which comprise first and second side surfaces subtending the same predetermined angle, a riser surface interconnecting the side surfaces, and a step surface. The recess in the driven member is characterized by member walls which are drivingly engagable with the side surfaces of the tool member.

10 Claims, 4 Drawing Figures

TORQUE-TRANSMITTING TOOL ASSEMBLY

FIELD OF THE INVENTION

The present invention relates generally to tools for imparting a torque to a driven member.

DESCRIPTION OF THE INVENTION

Figure 1:
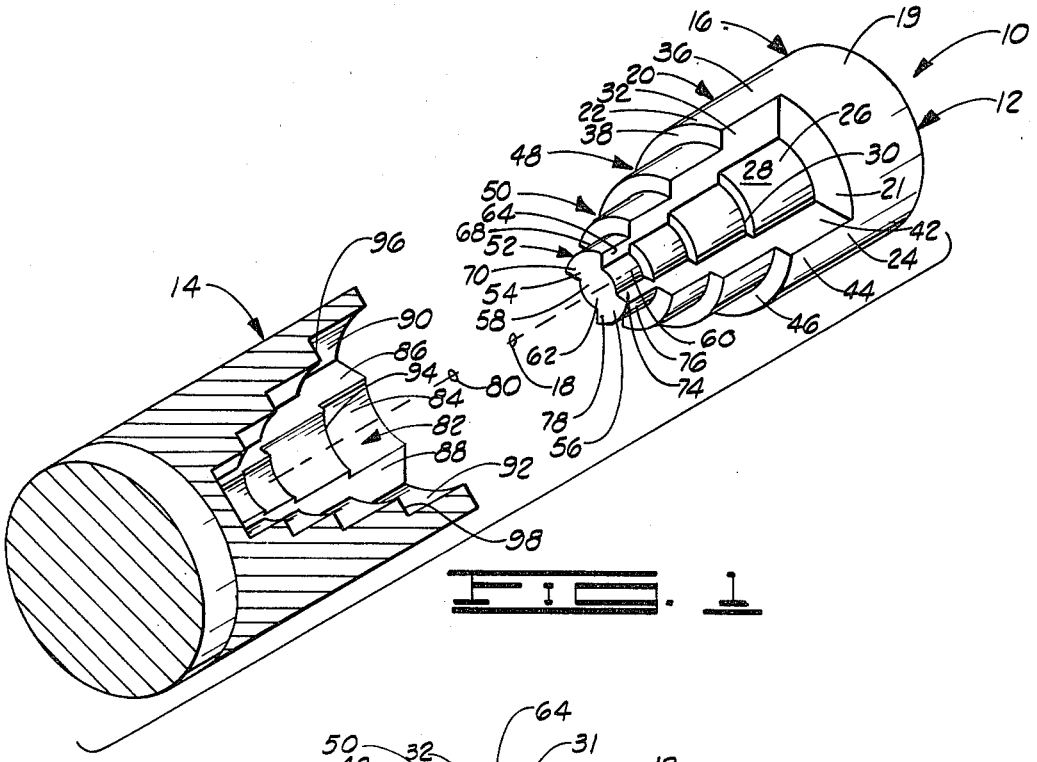
FIG. 1 is an isometric view of the tool member and driven member of the present invention, with the driven member partially cut away to permit better display of the recess formed therein.
Figure 2:
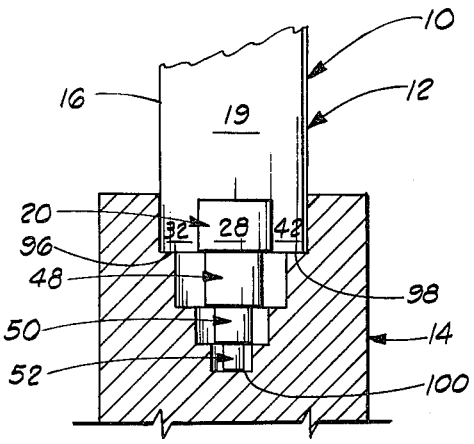
FIG. 2 is an elevational view of the tool member in its assembled configuration with the driven member of the present invention, with the driven member partially cut away.

With reference to FIGS. 1 and 2, the torque-transmitting tool assembly of the present invention, generally designated by reference numeral 10, comprises a tool member 12 receivable in a driven member 14. The tool member 12 comprises a plurality of tier elements and an apex element supported on a shank element. The tier elements and apex element of the tool member 12 are received within an appropriately sized recess in the driven member 14, whereby the tool member 12 and driven member 14 assume an assembled configuration. An externally applied torque may then be transmitted to the tool member 12 and therefrom to the driven member 14. In light of this summary, the construction and operation of the torque-transmitting tool assembly 10 will now be described in detail.

As shown in FIGS. 1 and 2, the tool member 12 comprises a shank element 16, preferably cylindrical in shape, which is longitudinally rotatable about, and symmetrical with, a tool axis 18. The shank element is characterized by walls 19, and by an upper surface 21. The shank element 16 may be provided with a torque receptor (not shown) for receiving an externally applied torque about the tool axis 18; the torque receptor may comprise a handle with which a user of the tool member 12 may manually apply torque, or it may comprise a conventional connection to a mechanical source of torque about the tool axis 18.

Further comprising the tool member 12 is a first tier element 20 supported by the shank element 16 and preferably integral therewith. The first tier element 20 is rotatable with the shank element 16 about the tool axis 18, and is characterized by invariant cross-section along the tool axis 18, as will more fully appear hereafter. Comprising the first tier element 20 is a first torque section 22, a second torque section 24, and a core section 26.

The core section 26 is preferably cylindrical in shape and concentric with the tool axis 18. The core section 26 is characterized by a peripheral wall 28 having upper and lower ends and having a radius, respective to the tool axis 18, which is smaller than the radius of the shank element 16. At the lower end of the peripheral wall 28, the core section 26 is engaged to, and preferably integral with, the shank element 16, adjacent the upper surface 21. At the upper end of the peripheral wall 28, which is the terminal edge of the peripheral wall most distant from the shank element 16, the core section 26 comprises a ridge surface 30, comprising an annular surface extending perpendicularly to the tool axis 18.

Figure 3:
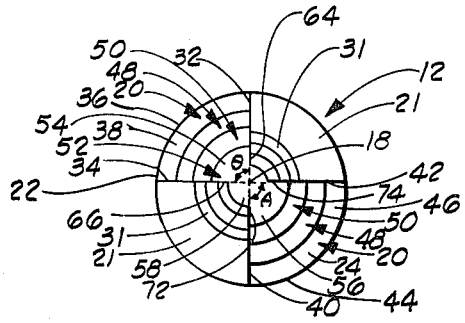
FIG. 3 is a plan view of the tool member of the present invention.

With continued reference to FIGS. 1 and 2, the first torque section is preferably integral with the core section 26 and comprises a first side surface 32 and a second side surface 34 (shown in FIG. 3). As is best shown in the plan view of FIG. 3, the first and second side surfaces 32 and 34 are each coplanar with the tool axis 18 (which extends perpendicularly to the page). As best shown in FIGS. 1 and 3, the first and second side surfaces 32 and 34 extend radially inward to the tool axis 18, but are spaced apart from the tool axis 18. With reference to FIG. 3, the respective planes containing the first and second side surfaces 32 and 34 intersect at the tool axis 18 and subtend a predetermined angle which will be designated as $\theta$.

Further comprising the first torque section 22 is a riser surface 36, shown in FIGS. 1 and 3. The riser surface 36 extends longitudinally from the walls 19 of the shank element 16 and extends laterally between the first and second side surfaces 32 and 34. The riser surface 36 preferably extends concentrically with respect to the tool axis 18, and is characterized by a radius equal to that of the walls 19 of the shank element 16. Since, as previously noted, the first tier element 20 is invariant in cross-section along the tool axis 18, the riser surface 36 is characterized by a constant radius of curvature; further, the longitudinal displacement of the riser surface 36 along the tool axis 18 is equal to that of the first and second side surfaces 32 and 34.

With continued reference to FIGS. 1 and 3, the first torque section 22 further comprises a step surface 38, extending perpendicularly to the tool axis 18 from the terminal edge of the riser surface 36 most distant from the shank element 16. The step surface 38 extends inwardly toward the tool axis 18, while remaining spaced therefrom. The step surface 38 therefore comprises a strip-shaped surface characterized by concentric arcuate sides, interconnected by ends extending radially toward the common center of curvature of the arcuate sides; the arcuate sides both subtend the predetermined angle $\theta$.

The second torque section 24 is identical in configuration to the first torque section 22, but is rotationally offset by 180°, about the tool axis 18, from the first torque section 22, while remaining integral with the core section 26. As shown in FIGS. 1, 2 and 3, the second torque section 24 comprises a first side surface 40 and a second side surface 42. As shown in FIGS. 1 and 3, the first and second side surfaces 40 and 42 are each coplanar with the tool axis 18 and extend radially toward the tool axis 18, while remaining spaced therefrom. As shown in FIG. 3, the respective planes containing the first and second side surfaces 40 and 42 intersect at the tool axis 18 and subtend the predetermined angle $\theta$.

The second torque section 24 further comprises a riser surface 44, shown in FIGS. 1 and 3. The riser surface 44 extends longitudinally from the walls 19 of the shank element 16 and extends laterally between the first and second side surfaces 40 and 42. The riser surface 44 preferably extends concentrically with respect to the tool axis 18, and is characterized by a radius equal to that of the riser surface 36 and the walls 19 of the shank element 16. Since the first tier element 20 is invariant in cross-section along the tool axis 18, the riser surface 44 is characterized by a constant radius of curvature and by a longitudinal displacement along the tool axis 18 equal to that of the riser surface 36, and to that of the first and second side surfaces 32 and 34, and to that of the first and second side surfaces 40 and 42.

As shown in FIGS. 1 and 3, the second torque section 24 further comprises a step surface 46, extending perpendicularly to the tool axis 18 from the terminal edge of the riser surface 46 more distant from the shank element 16. The step surface 46 extends inwardly toward the tool axis 18, while remaining spaced therefrom. The step surface 46 therefore comprises a strip-shaped surface, identical in shape to the step surface 38 of the first torque section 22, characterized by concentric arcuate sides, interconnected by ends extending radially toward the common center of curvature of the arcuate sides; the arcuate sides both subtend the predetermined angle $\theta$.

While two torque sections have been shown in the Figures, additional torque sections, identical in configuration to the first and second torque sections 22 and 24, may be provided for the first tier element 20, and may be made integral with the core section 26. The torque sections should be spaced at equal angular separation, with respect to adjacent torque sections, around the tool axis 18.

The tool member 12 preferably comprises one of a plurality of tier elements. Shown in FIGS. 1, 2 and 3, in addition to the first tier element 20, are a second tier element 48 and a third tier element 50; however, it will be understood that any appropriate number of tier elements may be provided. The second tier element 48 is supported by the first tier element 20; the third tier element 50 is in turn supported by the second tier element 48. In general, each additional tier element is supported by the adjacent tier element nearer the shank element 16. Each pair of adjacent tier elements are preferably integral with one another.

As best shown in FIGS. 1 and 3, additional tier elements such as the second and third tier elements 48 and 50 are, like the first tier element 20, characterized by invariant cross-section along the tool axis 18. Each tier element comprises a cylindrical core section concentric with the tool axis 18, and preferably has a radius of curvature smaller than the radius of the core section of the adjacent tier element nearer the shank element 16. Thus, the core section of the third tier element 50 has a smaller radius of curvature than the core section of the second tier element 48, which in turn has a smaller radius of curvature than the core section 26 of the first tier element 20.

Each core section further comprises a ridge surface, of annular shape, extending perpendicularly to the tool axis 18 from the terminal edge of the peripheral wall most distant from the shank element 16. As shown in FIG. 1, the ridge section of each core section interconnects the peripheral wall of that core section with the peripheral wall of the adjacent core section more distant from the shank element 16.

With continued reference to FIGS. 1 and 3, each of the additional tier elements, such as the tier elements 48 and 50, further comprises a first and second torque section, both torque sections preferably integral with the respective core section of that tier element. Like the first and second torque sections 22 and 24 of the first tier element 20, the first and second torque sections of each additional tier element are identical in configuration, and are rotationally offset from one another by 180° respective to the tool axis 18. Each torque section comprises first and second side surfaces coplanar with the tool axis 18 and extending radially toward the tool axis 18, while remaining spaced therefrom. The planes containing the first and second side surfaces of each torque section of each tier element intersect at the tool axis and subtend the predetermined angle $\theta$, as best shown in FIG. 3.

The first side surface and second side surface of the first torque section of each additional tier element, such as either tier element 48 or 50, are coplanar with, respectively, the first side surface 32 and second side surface 34 of the first torque section 22 of the first tier element 20. In like manner, the first side surface and second side surface of the second torque section of each of additional tier element are coplanar with, respectively, the first side surface 40 and second side surface 42 of the second torque section 24 of the first tier element 20.

Each torque section of each additional tier element, such as either tier element 48 or 50, further comprises a riser surface extending longitudinally from the step surface of the adjacent torque section of the adjacent tier element nearer the shank element 16, and extending laterally between the first and second side surfaces of the respective torque section of its tier element. The riser surface of each torque section is preferably concentric with the tool axis 18 and is characterized by a radius of curvature smaller than that of the adjacent riser surface of the adjacent torque section of the adjacent tier element nearer the shank element 16. Because each additional tier element is invariant in cross-section along the tool axis 18, each riser surface features a constant radius of curvature; further, for a given tier element, the longitudinal displacement of each riser surface of each torque section is equal to that of the first and second side surfaces of each torque section.

Each torque section of each additional tier element, such as either tier element 48 or 50, further comprises a step surface extending perpendicularly to the tool axis 18 from the terminal edge of the riser surface most distant from the shank element 16. The step surface of each torque section interconnects its riser surface with the riser surface of the adjacent torque section of the adjacent tier element more distant from the shank element 16. Each step surface extends inwardly toward the tool axis 18, while remaining spaced therefrom. Each step surface therefore comprises a strip-shaped surface characterized by concentric arcuate sides interconnected by ends extending radially toward the common center of curvature, of the arcuate sides (the tool axis 18); the arcuate sides of each step surface subtend the predetermined angle $\theta$, as shown in FIG. 3. Because the riser surfaces are disposed more closely to the tool axis 18 for tier elements more distant from the shank element 16, and because the step surfaces interconnect the riser surfaces of adjacent tier sections, it will be understood that the step surfaces are likewise disposed more closely to the tool axis for tier elements more distant from the shank element 16.

As is best shown in FIG. 1, the side surfaces of the torque section of each tier element extend between the peripheral wall of the core section and the riser surface of that torque section. The radii of the peripheral walls and the riser surfaces are selected so that the first side surfaces of a torque section are contiguous (and coplanar) with the first side surfaces of adjacent torque sections of adjacent tier elements. In like manner, the second side surface of a torque section is contiguous (and coplanar) with the second side surfaces of adjacent torque sections of adjacent tier elements.

With further reference to FIG. 1, it will be noted that tier elements nearer the shank element 16 are characterized by greater length, or longitudinal displacement, along the tool axis 18, than those tier elements more distant from the shank element 16. Likewise, the radii of the peripheral wall and riser surfaces are such that the radial displacement, or width, of the side surfaces is greater for tier elements nearer the shank element 16. Thus, the surface area of side surfaces is greater for side surfaces of tier elements, nearer the shank element 16. The operational consequences of this feature will be discussed hereafter.

From the foregoing description, it will be appreciated that the tier elements are integrally and coaxially stacked upon one another, and are in turn supported on the shank element 16. The tier elements are identical to one another, except in two respects: (1) the radius of curvature of the riser surface of the torque sections becomes smaller for tier elements more distant from the shank element 16; and (2) the longitudinal displacement of a tier element along the tool axis becomes larger for tier elements disposed more closely to the shank element 16.

While the additional tier elements just described have been characterized as having two torque sections, it will be understood that any appropriate number of torque sections may be provided and made integral with the core section of each operating element, in like manner to that previously discussed with reference to the first tier element 20.

Further comprising the tool member 12, as shown in FIGS. 1, 2 and 3, is an apex element 52 supported on the tier element most distant from the shank element 16, and preferably integral with this most distant tier element, (the third tier element 50 in the Figures); the apex element 52 is therefore most distant from the shank element 16 than the first tier element 20. The apex element 52 is rotatable with the shank element 16 about the tool axis 18, and is characterized by invariant cross-section along the tool axis 18, as will more fully appear hereafter. Comprising the apex element 52 is a first torque section 54, a second torque section 56, and a core section 58.

The core section 58 is preferably cylindrical in shape and concentric with the tool axis 18. The core section 58 is characterized by a peripheral wall 60 having upper and lower ends and having a radius, respective to the tool axis 18, which is smaller than the radius of the third tier element 50. At the lower end of the peripheral wall 60, the core section 58 is engaged to, and preferably integral with, the third tier element 16, adjacent the ridge surface and step surfaces thereof. At the upper end of the peripheral wall 60 the core section 58 comprises an apex surface 62, comprising a circular surface extending perpendicularly to the tool axis 18 from the terminal edge of the peripheral wall 60 most distant from the third tier element 58.

With continued reference to FIGS. 1 and 2, the first torque section 54 is preferably integral with the core section 58 and comprises a first side surface 64 and a second side surface 66 (shown in FIG. 3). As is best shown in the plan view of FIG. 3, the first and second side surfaces 64 and 66 are each coplanar with the tool axis 18 (which extends perpendicularly to the page). As best shown in FIGS. 1 and 3, the first and second side surfaces 64 and 66 extend radially inward to the tool axis 18, but are spaced apart from the tool axis 18. With reference to FIG. 3, the respective planes containing the first and second side surfaces 64 and 66 intersect at the tool axis 18 and subtend the predetermined angle $\theta$.

Further comprising the first torque section 54 is a riser surface 68, shown in FIG. 1. The riser surface 68 extends longitudinally from the step surface of the first torque section of the third tier element 50 and extends laterally between the first and second side surfaces 64 and 66. The riser surface 68 preferably extends concentrically with respect to the tool axis 18, and is characterized by a radius of curvature less than that of the riser surface of the third tier element 50. Since, as previously noted, the apex element 52 is invariant in cross-section along the tool axis 18, the riser surface 68 is characterized by a constant radius of curvature; further, the longitudinal displacement of the riser surface 36, along the tool axis 18, is equal to that of the first and second side surfaces 64 and 66.

With continued reference to FIGS. 1 and 3, the first torque section 54 further comprises an apex surface 70, extending perpendicularly to the tool axis 18 from the terminal edge of the riser surface 68 most distant from the shank element 16. The apex surface 70 extends inwardly toward the tool axis 18, while remaining spaced therefrom. The apex surface 70 therefore comprises a strip-shaped surface characterized by concentric arcuate sides, interconnected by ends extending radially toward the common center of curvature of the arcuate sides; the arcuate sides both subtend the predetermined angle $\theta$. The apex surface 70 is contiguous to the apex surface 62 of the core section 58.

The second torque section 24 is identical in configuration to the first torque section 54, but is rotationally offset by 180°, about the tool axis 18, from the first torque section 54, while remaining integral with the core section 58. As shown in FIGS. 1 and 3, the second torque section 24 comprises a first side surface 72 and a second side surface 74. As shown in FIGS. 1 and 3, the first and second side surfaces 72 and 74 are each coplanar with the tool axis 18 and extend radially toward the tool axis 18, while remaining spaced therefrom. As shown in FIG. 3, the respective planes containing the first and second side surfaces 72 and 74 intersect at the tool axis 18 and subtend the predetermined angle $\theta$.

The second torque section 56 further comprises a riser surface 76 shown in FIG. 1. The riser surface 76 extends longitudinally from the step surface of the second torque section of the third tier element 50 and extends laterally between the first and second side surfaces 72 and 74. The riser surface 62 preferably extends concentrically with respect to the tool axis 18, and is characterized by a radius equal to that of the riser surface 68 and less than that of the riser surface of the second torque section of the third tier element 50. Since the apex element 50 is invariant in cross-section along the tool axis 18, the riser surface 76 is characterized by a constant radius of curvature, and by a longitudinal displacement along the tool axis 18 equal to that of the riser surface 68, and to that of the first and second side surfaces 64 and 66, and to that of the first and second side surfaces 72 and 74.

As shown in FIG. 1, the second torque section 56 further comprises an apex surface 78, extending perpendicularly to the tool axis 18 from the terminal edge of the riser surface 76 more distant from the shank element 16. The apex surface 78 extends inwardly toward the tool axis 18, while remaining spaced therefrom. The apex surface 78 therefore comprises a strip-shaped surface, identical in shape to the step surface 70 of the first torque section 54, characterized by concentric arcuate sides, interconnected by ends extending radially toward the common center of curvature of the arcuate sides (the tool axis 18); the arcuate sides both subtend the predetermined angle $\theta$. The apex surface 78 contiguous to the apex surface 62 of the core section 58.

While two torque sections have been shown in the Figures for the apex element 52, it will be understood that, as with the tier elements previously discussed, additional torque sections, identical in configuration to the first and second torque sections 54 and 56, may be provided for the apex element 52, and may be made integral with the core section 58. The torque sections should be spaced at equal angular separation, with respect to adjacent torque sections, around the tool axis 18.

The first side surface 64 and second side surface 66 of the first torque section 54 of the apex element 52 are coplanar with, respectively, the first side surface 32 and second side surface 34 of the first torque section 22 of the first tier element 20, and the corresponding side surfaces of the other tier elements. In like manner, the first side surface 72 and second side surface 74 of the second torque section 56 of each of the apex element 52 are coplanar with, respectively, the first side surface 40 and second side surface 42 of the second torque section 24 of the first tier element 20, and the corresponding side surfaces of the other tier elements.

The radii of the peripheral walls and the riser surfaces 68 and 76 are selected so that the first side surfaces 64 and 72 of the torque sections 54 and 56 are contiguous (and coplanar) with the first side surfaces of adjacent torque sections of the third tier element 50. In like manner, the second side surfaces 66 and 74 of the torque section are contiguous (and coplanar) with the second side surfaces of adjacent corresponding torque sections of the third tier element 50.

With further reference to FIG. 1, it will be noted that the side surfaces 64, 66, 72 and 74 are characterized by smaller length, or longitudinal displacement, along the tool axis 18 than those tier elements closer to the shank element 16. Likewise, the radii of the peripheral walls 60 and riser surfaces 68 and 76 are such that the radial displacement, or width, of the side surfaces 64, 66, 72 and 74 is smaller than the width of side surfaces of tier elements nearer the shank element 16. Thus, the surface area of the side surfaces 64, 66, 72 and 74 is smaller than the surface area of the side surfaces of tier elements nearer the shank element 16. The operational consequences of this feature will be discussed hereafter.

From the foregoing description, it will be appreciated that the apex element 52 is integrally and coaxially stacked upon the third tier element 50, and is thereby indirectly supported on the shank element 16. The apex element 52 is identical to the tier elements, except in three respects: (1) the radius of curvature of the riser surfaces 68 and 76 of the torque sections 54 and 56 is smaller than that of the riser surfaces of the tier elements which are nearer the shank element 16 than the apex element 52; (2) the longitudinal displacement of the apex element 52 along the tool axis is smaller than the displacement of tier elements, which are disposed more closely to the shank element 16; and (3) the apex element features a circular apex surface 62 extending perpendicularly to the riser surfaces 68 and 76, rather than the strip-shaped step surface extending perpendicularly to the riser surface of the tier elements.

While the apex element 52 just described has been characterized as having two torque sections, it will be understood that any appropriate number or torque sections may be provided and made integral with the core section 58 of the apex element 52, in like manner to that previously discussed with reference to the first tier element 20.

With reference to FIGS. 1 and 2, the driven member 14 may comprise the head of a bolt, screw, or other object to which an externally applied torque is to be applied. The driven member 14 is rotatable about a member axis 80, formed in the driven member 14 are a plurality of member walls which define a recess 82 in which the tool member 12 is receivable. The disposition and configuration of these member walls will now be discussed.

As shown in FIGS. 1 and 2, the member walls are disposed so that when the tool member 12 is received in the recess 82, each surface of the tier elements and apex element 52 of the tool member 12 is either engaged with or closely adjacent to a substantially coextensive member wall. Thus, immediately adjacent the aperture 82, as shown in FIG. 1, the driven member 14 comprises a first guiding wall 84, concentric with the member axis 80, having a longitudinal displacement along the member axis 80 equal to, and having a radius of curvature about the member axis 80 slighlty greater than, the peripheral wall 28 of the first tier element 20 relative to the tool axis 18. The wall 84, like the peripheral wall 28, subtends an angle $(180-\theta)^\circ$ relative to its center of curvature.

Extending from one lateral extremity of the first guiding wall 84 is a flat first side engagement wall 86 which is characterized by longitudinal displacement along the members axis 80 equal to longitudinal displacement of the second side surface 34 of the first torque section 22, along the tool axis 18. The wall 86 is further characterized by a radial displacement from the member axis 80 slightly greater than the radial displacement of the second side surface 34 of the first torque section 22 along the tool axis 18.

Extending from the opposite lateral side of the first guiding surface 84 is a flat second side engagement wall 88, which is characterized by longitudinal displacement along the member axis 80 equal to longitudinal displacement of the first side surface 40 of the second torque section 24 along the tool axis 18; the wall 88 is further characterized by a radial displacement from the member axis 80 slightly greater than the radial displacement of the first side surface 40 of the second torque section 24 along the tool axis 18.

The walls 86 and 88 are each coplanar with the member axis 80; at the intersection of the planes containing these walls 86 and 88, the planes subtend the angle $(180-\theta)^\circ$, the same angle subtended by the planes containing the second side surface 34 and first side surface 40. The walls 86 and 88 have the same longitudinal displacement along the member axis 80 as the first guiding wall 84.

With continued reference to FIG. 1, extending from the lateral side of the first side engagement wall 86 opposite the lateral side contiguous with the first guiding wall 84 is a second guiding wall 90, concentric about the member axis 80, and having a longitudinal displacement along the member axis 80 equal to that of the walls 84, 86 and 88, and equal to that of the riser surface 36 of the first torque section 22 relative to the tool axis 18. The second guiding wall 90 is characterized by radial displacement from the member axis 80 which is slightly greater than the radial displacement of the riser surface 36 from the tool axis 18. The second guiding wall 90 subtends the angle $\theta$ relative to the member axis 80, just as the riser surface 36 subtends the same angle relative to the tool axis 18.

Further characterizing the recess 82 is a third guiding wall 92 extending from the lateral side of the second side engagement wall 88 opposite the lateral side contiguous with the first guiding wall 84. The third guiding wall 92 is concentric with the member axis 80, and is characterized by a longitudinal displacement along the member axis 80 equal to that of the walls 84, 86, 88 and 90, and further equal to the longitudinal displacement of the riser surface 44 of the second torque section 24. The third guiding wall 92 is characterized by radial displacement from the member axis 80 which is slightly greater than the radial displacement of the riser surface 44 from the tool axis 18. The third guiding wall 92 subtends the angle $\theta$ relative to the member axis 80, just as the riser surface 44 subtends the same angle relative to the tool axis 18.

Although not shown in the cutaway view of FIG. 1, the recess 82 further comprises a flat third side engagement wall corresponding to the first side surface 82 and extending contiguously to the second guiding wall 90; the recess 82 further comprises a flat fourth side engagement wall corresponding to the second side surface 42. The third and fourth side engagement walls are coplanar with the member axis 80; the planes containing these walls intersect at the member axis 80 and subtend the angle $(180-\theta)°$. The third and fourth side engagement walls are radially displaced from the member axis 20 to a slightly greater extent than the corresponding side surfaces 32 and 42 are displaced from the tool axis 18.

The third and fourth side engagement surfaces are interconnected by a fourth guiding wall, concentric with the member axis 20 and having a radial displacement from the member axis 80 slightly greater than the radial displacement of the peripheral wall 28 from the tool axis 18. The third and fourth engagement surfaces and the fourth guiding wall are all characterized by longitudinal displacement along the member axis 80 equal to that of the walls 84, 86, 88 and 90.

Further comprising the recess 82 is a first ridge engagement wall 94, partially shown in FIG. 1, which extends perpendicularly to the member axis 80 and inwardly toward the member axis 80 from the first guiding wall 84. The first ridge engagement wall 94, which is concentric with the member axis 80, has an outer radius slightly grater than that of the peripheral wall of the first tier element 20 and an inner radius slightly greater than that of the peripheral wall of the second tier element 48.

A second ridge engagement wall (not shown) extends perpendicularly to the member axis 80 from the fourth guiding wall and extends perpendiclarly to and inwardly toward the member axis 80. The second ridge engagement wall is concentric with the member axis 80, and is characterized by an outer radius slightly greater than that of the peripheral wall 28 of the first tier element 20, and an inner radius slightly greater than that of the peripheral wall of the second tier element 48.

As shown in both FIGS. 1 and 2, the recess 82 further comprises a first step engagement wall 96 extending perpendicularly to the member axis 80 from the second guiding wall 90 and inwardly toward the member axis 80 therefrom. The first step engagement wall 96 is concentric with the member axis 80, and is characterized by an outer radius slightly greater than that of the riser surface 36 of the first tier element and an inner radius slightly greater than that of the corresponding riser surface of the second tier element 48.

With continued reference to FIGS. 1 and 2, the recess 82 further comprises a second step engagement wall 98 extending perpendicularly to the member axis 80 from the second guiding wall 90, and inwardly toward the member axis 80 therefrom. The second step engagement wall 98 is concentric with the member axis 80, and is characterized by an outer radius slightly greater than that of the riser surface 44 of the first tier element 20, and an inner radius slightly greater than that of the corresponding riser surface of the second tier element 48.

When the tool member 12 is received in the recess 82 of the driven member 14, prior to the application of a torque, the ridge elements of first tier element 20 are disposed in parallel contacting engagement with the first and second ridge engagement walls formed in the driven member 14. In like manner, the step surfaces 46 are disposed in parallel, contacting engagement with first and second step engagement walls 96 and 98 formed in the driven member 14. When the tool member 12 is received in the driven member 14 the first and second side surfaces 32 and 34 of the torque section 22 are disposed in parallel, closely adjoining relationship respectively, with the third side engagement wall and the first side engagement wall 86 formed in the driven member 14. The first and second side surfaces 40 and 42 of the second torque section 24 are disposed in parallel, closely adjoining relationship, respectively, with the second side engagement wall 88 and the fourth side engagement wall.

Further, when the tool member 14 is received in the driven member 16, the peripheral walls of the first tier member 20 are disposed in concentric, closely adjoining relationship to first guiding wall 84 and the fourth guiding wall. The riser surfaces 36 and 44 are disposed in parallel, closely adjoining relationship, respectively, with the second guiding wall 90 and third guiding wall 92.

The guiding walls and engagement walls defining the recess 82 cooperate to position the tool member 12 so that its tool axis 18 is substantially coextensive with the member axis 20 when the tool member 12 is received in the driven member 14. When the tool member 12 is received in the driven member 14, and is thereafter driven by an externally applied torque to rotate in one direction about the tool axis 18, the second side surfaces 34 and 42 will be rotated into pressing engagement with the first side engagement wall 86 and fourth engagement wall. The pressing, or driving, engagement will cause the externally applied torque to be transmitted to the driven member 14 and will cause the driven member 14 to rotate about the member axis 80. When the tool member 12 is driven by an externally applied torque to rotate in the opposite direction about the tool axis 18, the first side surfaces 32 and 40 will be rotated into pressing engagement with the third side engagement wall and the second side engagement wall 88. This pressing, or driving, engagement will cause the externally applied torque to be transmitted to the driven member 14, and will cause the driven member 14 to rotate about the member axis 80, in the opposite direction from that discussed above.

It will be noted that, because of the presence of the first ridge engagement wall 94 and second ridge engagement wall and first and second step engagement walls 96 and 98, the tool member 12 will be retained so that the side surfaces are maintained in engagable relationship with the side engagement walls, even when a force is applied to the tool member 12 along the tool axis 18 and into the driven member 14. This feature permits the driven member 14 to be rotated, by application of the external torque, and simultaneously moved along the member axis 80, as may be required if the driven member 14 comprises a screw or bolt.

As shown in FIG. 2, the recess 82 may be characterized by additional member walls corresponding to each tier element and to the apex element 52 of the tool member 12. Thus, guiding walls are provided which are concentric with, and closely adjacent to the peripheral walls and riser surfaces of each tier and apex element when the tool member 12 is received in the driven member 14. Likewise, flat step and ridge engagement walls are provided which are disposed in parallel engagement with the ridge and step surfaces of the tool member 12, when the tool member 12 is received in the driven member 14. Finally, flat side engagement walls are provided which are parallel to and close adjacent to the side surfaces of each tier and apex element.

With continued reference to FIG. 2, a flat apex engagement wall 100 extends perpendicularly to the member axis 80 and defines the base of the aperture. When the tool member 12 is received in the driven member 14, the apex surfaces 62, 70 and 78 are disposed in parallel engagement with the apex engagement wall 100. Additionally, flat side engagement walls are provided which are disposed parallel to, and closely adjacent to the side surfaces of the tier and apex elements.

In the embodiment shown in FIG. 2, it will be understood that the side engagement walls corresponding to the side surfaces of each tier and apex element are disposed to engage with the side surfaces of the tool member. Thus, in the embodiment shown in FIG. 7, the recess 82 is constructed so that the driven member 14 may receive externally applied torque from the side surfaces of each tier and apex element of the tool member 12. Thus, the construction of the recess 82 in FIG. 2 provides for maximum utilization of the torque-transmitting capacity of the tool member 12.

It was previously noted that the side surfaces of the tier elements disposed closer to the shank element 16 are characterized by larger surface areas that the side surfaces of the apex element 52 and the tier elements disposed farther from the shank element 16. Since the torque transmitted to the driven member 14 is proportional to the distance from the member axis 80 at which force is applied, it will be appreciated that the greatest component of torque may be transmitted in that portion of the recess 82 which is most distant from the member axis 80. The side engagement walls most distant from the member axis 80, which are adjacent the opening of the recess 82, are therefore preferably of large surface area, so that they may receive maximal force from the tool member 14. The sizing of these side engagement walls therefore cooperates with their distance from the member axis 20 to provide for transmission of a large component of torque through the first tier element 20 to the driven member 14.

The apex element 52 and the tier elements more distant from the shank element 16 are disposed closer to the tool axis 18, and therefore closer to the member axis 20, when the tool member 12 is received in the driven member 14. These elements therefore transmit a smaller component of the externally applied torque, and therefore may have side surfaces smaller in surface area to transmit this torque. Consequently, the side surfaces are characterized by surface areas which are inversely related to their distance from the shank element 16.

In the event that the torque transmittable by the first tier element 20 is not required to turn the drive member 14, the aperture in the driven member 14 may be sized to receive only the second tier element 48 and the tier elements and apex element more distant from the shank element 16 than the second tier element 48. The member walls of the aperture are formed in a manner identical to that previously described with reference to the embodiment shown in FIG. 2, except that the aperture does not admit the first tier element 20. In like manner, the aperture may be sized to admit only the apex element 52, or only the apex element 52 and the number of adjacent tier elements necessary to provide the torque transmission necessary to turn the driven member 14.

Figure 4:
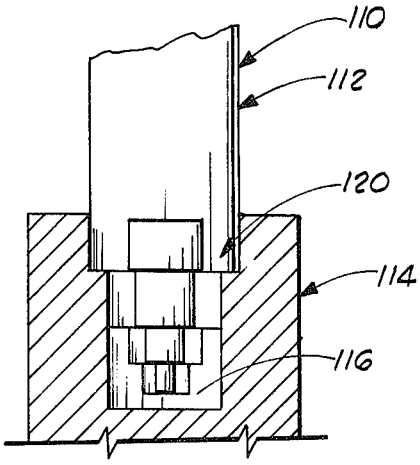
FIG. 4 is an elevational view of the tool member of the present invention in its assembled configuration with another embodiment of driven member, having a different type of recess formed therein. The driven member is shown partially cut away.

FIG. 4 shows another embodiment of the tool assembly of the present invention, generally designated by reference numeral 110; the tool assembly 110 comprises a tool member 112, identical to the tool member described with reference to FIGS. 1, 2 and 3, receivable in a driven member 114. Formed in the driven member 114 is a recess 116 in which the tool member 112 is received. The recess 116 is characterized by member walls which are closely adjacent to, or in engagement with, the surfaces of the first tier element 120 of the tool member 112 when the tool member 112 is received in the recess 116, in a manner identical to that previously described with reference to the tool member 12 and driven member 14. However, the remaining walls of the recess 116 are disposed so as not to be engageable with the tool member 112 when it is received in the recess 116. Thus, torque is transmitted solely through the first tier element 120 of the tool member 112. Consequently, precision sizing of the member walls not adjacent the first tier element 120 is not required, which may reduce production costs for the driven member 114.

In like manner, the recess in the driven member 114 may be sized to receive any selected tier element of the tool member 112, with tier elements nearer the shank element of the tool member 112 than the selected tier element remaining outside the recess 116. The aperture is further sized so that tier elements and the apex element more distant from the shank element than the selected tier element are not engageable with the tool member 112 when it is received in the recess. In such an embodiment, torque will be transmitted solely through the selected tier element of the tool member 112.

From the foregoing description, it will be appreciated that a single tool member of the present invention may be employed to transmit torque to driven members having recesses of differing size; the recess sizes may correspond to any of the various tier and apex elements comprising the tool member. It will further be appreciated that the tool member of the present invention applies force to the driven member through the flat side surfaces at right angles to the direction of turning motion of the tool member. The area of contact between the driven member and the tool member is thus much larger than would be the case with a conventional hexagonal bolt head and in socket wrench or open ended wrench.

It will be further appreciated that, because force is applied only at right angles to the direction of turning motion of the tool member, there is no shearing stress applied to the driven member by the tool member. This feature contrasts with the characteristics of the above-mentioned hexagonal bolt head and wrench assembly; the hexagonal corners will be worn down by shearing stress resulting from wrench action; the wrench applies force at a 180° angle to the direction of turning motion. Excessive wear may eventually result in slippage of the wrench on the bolt. Because of the absence of shearing stresses, these undesirable features do not occur in the present invention.

When the tool assembly of the present invention is received in the recess of the driven member, the only member walls drivingly engaged with the tool member are the step, ridge and apex engagement walls, which are prependicular to the member axis, and the side engagement walls, which are coplanar with the member axis. Thus, the engagement of the tool member in the driven member does not result in any component of force which would urge the tool member out of the recess or cause slippage of the tool member relative to the driven member.

Finally, it will be appreciated that in the tool assembly of the present invention, because of the large area of contact between the tool member and driven member, a smaller tool member may be employed then would be the case if a conventional wrench were employed, which is not capable of contacting as large a surface area on the driven member.

Changes may be made in the construction and arrangement of the various elements of the various embodiments as disclosed therein without departing from the spirit and scope of the invention in the following claims.

What is claimed is:

1. A tool for transmitting an externally applied torque to an object, comprising:

a shank element, longitudinally rotatable about a tool axis, for receiving an externally applied torque;

a first tier element, rotatable with and supported by the shank element and having invariant cross-section along the tool axis, comprising:

a first torque section, comprising:

first and second side surfaces, spaced from and extending radially inward in relation to the tool axis, the first and second side surfaces subtending a predetermined angle with respect to the tool axis;

a riser surface extending longitudinally with respect to the tool axis, and extending laterally between the first and second side surfaces; and a step surface extending perpendicularly to the tool axis and inwardly from the riser surface, while remaining spaced from the tool axis; and a second torque section, comprising:

first and second side surfaces, spaced from and extending radially inward in relation to the tool axis, the first and second side surfaces subtending the same predetermined angle, relative to the tool axis, as that subtended by the first and second side surfaces of the first torque section;

a riser surface extending longitudinally with respect to the tool axis, and extending laterally between the first and second side surfaces; and a step surface extending perpendicularly to the tool axis and inwardly from the riser surface, while remaining spaced from the tool axis; and an apex element, supported at a position on the tool axis move distant from the shank element than the first tier element, rotatable with the shank element, and having an invariant cross-section along the tool axis, comprising:

a first torque section, comprising:

first and second side surfaces, extending radially inward in relation to the tool axis, the first and second side surfaces subtending the same predetermined angle, relative to the tool axis, as that subtended by the first and second side surfaces of the first torque section of the first tier element, with the first side surface coplanar with the first side surface of the first torque section of the first tier element, and with the second side surface coplanar with the second side surface of the first torque section of the first tier element;

a riser surface, extending longitudinally with respect to the tool axis, and extending laterally between the first and second side surfaces, the riser surface having an average distance from the tool axis which is smaller than the average distance of the riser surface of the first tier element from the tool axis; and an apex surface extending perpendicularly to the tool axis and extending inwardly fron the riser surface, while remaining spaced from the tool axis; and a second torque section, comprising:

first and second side surfaces, extending radially inward from in relation to the tool axis, the first and second side surfaces subtending the same predetermined angle, relative to the tool axis, as that subtended by the first and second side surfaces of the second torque sections of the first tier element, with the first side surface coplanar with the first side surface of the second torque section of the first tier element, and with the second side surface coplanar with the second side surface of the second torque section of the first tier element;

a riser surface, extending longitudinally with respect to the tool axis, and extending laterally between the first and second side surfaces, the riser surface having an average distance from the tool axis which is smaller than the average distance of the riser surface of the first tier element from the tool axis; and an apex surface extending perpendicularly to the tool axis and extending inwardly from the riser surface, while remaining spaced from the tool axis.

2. The apparatus of claim 1 in which each riser surface of each torque section of each tier and apex element extends concentrically with respect to the tool axis.

3. The apparatus of claim 2 in which the first tier element further comprises:

a core section concentric with the tool axis and integral with the first and second torque sections;

and in which the apex element further comprises:

a core section concentric with the tool axis and integral with the first and second torque sections.

4. The apparatus of claim 2 in which the first tier element is characterized as one of a plurality of tier elements, each tier element comprising:

a first torque section having first and second side surfaces coplanar with the first and second side surfaces of the first torque section of the first tier element, a riser surface and a step surface;

a second torque section having first and second side surfaces coplanar with the first and second side surfaces of the second torque section of the first tier element, a riser surface and a step surface;

wherein each tier element supports the adjacent tier element more distant from the shank element, wherein the tier element most distant from the shank element supports the apex element, wherein the riser surface of each tier element is nearer to the tool axis than the riser surface of the adjacent tier element nearer the shank element, and wherein the riser surface of the apex element is nearer the tool axis than the riser surface of the adjacent tier element nearer the shank element.

5. A tool assembly for transmission of an externally applied torque, comprising:

a tool member comprising:

a shank element, longitudinally rotatable about a tool axis, for receiving an externally applied torque;

a first tier element, rotatable with and supported by the shank element and having invariant cross-section along the tool axis, comprising:

a first torque section, comprising:

first and second side surfaces, spaced from and extending radially inward in relation to the tool axis, the first and second side surfaces subtending a predetermined angle with respect to the tool axis;

a riser surface extending longitudinally with respect to the tool axis, and extending laterally between the first and second side surfaces; and a step surface extending perpendicularly to the tool axis and inwardly from the riser surface, while remaining spaced from the tool axis; and a second torque section, comprising:

first and second side surfaces, spaced from and extending radially inward in relation to the tool axis, the first and second side surfaces subtending the same predetermined angle, relative to the tool axis, as that subtended by the first and second side surfaces of the first torque section;

a riser surface extending longitudinally with respect to the tool axis, and extending laterally between the first and second side surfaces; and a step surface extending perpendicularly to the tool axis and inwardly from the riser surface, while remaining spaced from the tool axis; and an apex element, supported at a position on the tool axis more distant from the shank element than the first operating element, rotatable with the shank element, and having an invariant cross-section along the tool axis, comprising:

a first torque section, comprising:

first and second side surfaces, extending radially inward in relation to the tool axis, the first and second side surfaces subtending the same predetermined angle, relative to the tool axis, as that subtended by the first and second side surfaces of the first torque section of the first tier element, with the first side surface coplanar with the first side surface of the first torque section of the first tier element, and with the second side surface coplanar with the second side surface of the first torque section of the first tier element;

a riser surface, extending longitudinally with respect to the tool axis, and extending laterally between the first and second side surfaces, the riser surface having an average distance from the tool axis which is smaller than the average distance of the riser surface of the first tier element from the tool axis; and an apex surface extending perpendicularly to the tool axis and extending inwardly from the riser surface, while remaining spaced from the tool axis; and a second torque section, comprising:

first and second side surfaces, extending radially inward from in relation to the tool axis, the first and second side surfaces subtending the same predetermined angle, relative to the tool axis, as that subtended by the first and second side surfaces of the second torque sections of the first tier element, with the first side surface coplanar with the first side surface of the second torque section of the first tier element, and with the second side surface coplanar with the second side surface of the second torque section of the first tier element;

a riser surface, extending longitudinally with respect to the tool axis, and extending laterally between the first and second side surfaces, the riser surface having an average distance from the tool axis which is smaller than the average distance of the riser surface of the first tier element from the tool axis; and an apex surface extending perpendicularly to the tool axis and extending inwardly from the riser surface, while remaining spaced from the tool axis; and a driven member rotatable about a member axis and having a plurality of member walls defining a recess, the tool member receivable therein, the recess characterized as having member walls drivingly engagable with each of the first and second side surfaces of the first and second torque sections of the apex element of the tool member.

6. The apparatus of claim 5 in which the recess of the driven member is further characterized as having a member wall engagable with the apex surfaces of the first and second torque sections of the apex element.

7. The apparatus of claim 5 in which the recess of the drive member is further characterized as having member walls drivingly engagable with the first and second side surfaces of the first and second torque sections of the first tier element.

8. The apparatus of claim 7 in which the recess of the driven member is further characterized as having a member wall engagable with the step surfaces of the first and second torque sections of the first tier element.

9. A drive assembly for transmission of an externally applied torque, comprising:

a tool member, comprising:

a shank element longitudinally rotatable about a tool axis, for receiving an externally applied torque;

a plurality of tier elements having invariant cross-section along the tool axis, each tier element comprising:

a first torque section comprising:

first and second side surfaces extending radially with respect to the tool axis and spaced therefrom, the first and second side surfaces coplanar with the first and second side surfaces of the first torque section of each other tier element;

a riser surface; and a step surface; and a second torque section comprising:

first and second side surfaces extending radially with respect to the tool axis and spaced therefrom, the first and second side surfaces coplanar with the first and second side surfaces of the second torque section of each other tier element;

a riser surface; and a step surface;

wherein each tier element supports the adjacent tier element more distant from the shank element, and wherein the riser surface of each tier element is nearer to the tool axis than the riser surface of the adjacent tier element nearer the shank element; and a driven member, rotatable about a member axis and having a plurality of member walls defining a recess, the tool member receivable therein, the recess characterized as having member walls drivingly engagable with each of the first and second side surfaces of the first and second torque sections of a selected tier element.

10. The apparatus of claim 9 in which the recess of the driven member is further characterized as having member walls drivingly engagable with each of the first and second side surfaces of each of the first and second torque sections of each tier element located farther from the shank element than the selected operating element.

* * * * *